US010490124B2

(12) United States Patent
Xie

(10) Patent No.: US 10,490,124 B2
(45) Date of Patent: Nov. 26, 2019

(54) AMOLED EXTERNAL ELECTRICAL COMPENSATION DETECTION METHOD

(71) Applicant: SHENZHEN CHINA STAR OPTOELECTRONICS SEMICONDUCTOR DISPLAY TECHNOLOGY CO., LTD., Shenzhen, Guangdong (CN)

(72) Inventor: Hongjun Xie, Guangdong (CN)

(73) Assignee: SHENZHEN CHINA STAR OPTOELECTRONICS SEMICONDUCTOR DISPLAY TECHNOLOGY CO., LTD., Shenzhen (CN)

( * ) Notice: Subject to any disclaimer, the term of this patent is extended or adjusted under 35 U.S.C. 154(b) by 123 days.

(21) Appl. No.: 15/579,538

(22) PCT Filed: Nov. 25, 2017

(86) PCT No.: PCT/CN2017/112968

§ 371 (c)(1),
(2) Date: Dec. 4, 2017

(87) PCT Pub. No.: WO2019/075852

PCT Pub. Date: Apr. 25, 2019

(65) Prior Publication Data

US 2019/0228702 A1 Jul. 25, 2019

(30) Foreign Application Priority Data

Oct. 18, 2017 (CN) ..... 2017 1 0973491

(51) Int. Cl.
*G09G 3/3225* (2016.01)

(52) U.S. Cl.
CPC ... *G09G 3/3225* (2013.01); *G09G 2320/0233* (2013.01); *G09G 2330/12* (2013.01)

(58) Field of Classification Search
CPC ... G09G 3/3225; G09G 3/3283; G09G 3/3291
See application file for complete search history.

(56) References Cited

U.S. PATENT DOCUMENTS

2015/0054722 A1* 2/2015 Kanda ..... G09G 3/3233 345/77
2015/0325174 A1* 11/2015 Yu ..... G09G 3/3233 345/77
2016/0351096 A1* 12/2016 Tani ..... G09G 3/3233

FOREIGN PATENT DOCUMENTS

CN 103268756 8/2013
CN 104658485 5/2015
(Continued)

*Primary Examiner* — Kevin M Nguyen
(74) *Attorney, Agent, or Firm* — Hemisphere Law, PLLC; Zhigang Ma

(57) ABSTRACT

The present disclosure provides an AMOLED external electrical compensation detection method, in the display mode, estimating a cross-voltage between the drain and the source of the detecting TFT, calculating a gate-source voltage of the driving TFT based on the estimated value, it is possible to improve the writing precision of the gate-source voltage of the driving TFT; in the detection mode, estimating a cross-voltage between the drain and the source of the detecting TFT, calculating a source voltage of the driving TFT based on the estimated value, calculating the threshold voltage and the carrier mobility of the driving TFT based on the calculated voltage of the source of the driving TFT, it is possible to reduce the calculation error between the threshold voltage and the carrier mobility of the driving TFT and improve the accuracy of the external electrical compensation detection of the AMOLED.

11 Claims, 4 Drawing Sheets

(56) References Cited

FOREIGN PATENT DOCUMENTS

| | | |
|---|---|---|
| CN | 105243996 | 1/2016 |
| CN | 105895022 | 8/2016 |
| WO | WO 2013063991 | 5/2013 |

* cited by examiner

AMOLED EXTERNAL ELECTRICAL COMPENSATION DETECTION METHOD

RELATED APPLICATIONS

The present application is a National Phase of International Application Number PCT/CN2017/112968, filed on Nov. 25, 2017, and claims the priority of China Application 201710973491.1, filed on Oct. 18, 2017.

FIELD OF THE DISCLOSURE

The present disclosure relates to a display technology field, and more particularly to an AMOLED external electrical compensation detection method.

BACKGROUND OF THE DISCLOSURE

Organic light emitting display (OLED) has advantages of self-luminous, low drive voltage, high luminous efficiency, short response time, high definition and contrast, nearly 180° viewing angle, wide temperature range, flexible display and large area full color display, is recognized as the most promising display.

According to the drive mode, OLED displays can be divided into two categories: passive matrix OLEDs (PMOLED) and active matrix OLEDs (AMOLED), that is, direct addressing and thin film transistor (TFT) matrix addressing. Wherein the AMOLED display has a matrix arrangement of pixels, belonging to the active display type, high luminous efficiency, and is generally used for high-definition large-size display devices.

Since the AMOLED display is a current-driven display device, the uniformity and stability of the driving TFT affect the display effect. Specifically, the display brightness of each AMOLED pixel is uneven, and compensation is required. At present, the compensation technology for AMOLED in the industry includes internal compensation within the pixel and external compensation outside the pixel, wherein the external compensation is further divided into external optical compensation and external electric compensation. In the field of large-size AMOLED display, external electrical compensation technology is important. The principle is that the inhomogeneity of the TFT in the AMOLED pixel is obtained by the electrical detection method, and then the offset value is compensated at the pixel driving voltage. Therefore, the accuracy of the electrical detection directly affects the effect of the external electrical compensation.

Please also refer to FIG. 1 and FIG. 2, in the existing 3T1C structure of the external compensation pixel circuit, the first TFT T10 is a driving TFT for directly driving the organic light emitting diode D10; the second TFT T20 is a switching TFT for controlling the writing of the image data voltage Data; the third TFT T30 is a detecting TFT for writing a constant voltage Van to its own source in the display mode and detecting the voltage of the source s of the first TFT T10 in the detecting mode.

Please refer to FIG. 1, the existing external electrical compensation detection method ignores the cross-voltage between the gate and the source of the third TFT T30 in the display mode. It is considered that the voltage Vs of the source s of the first TFT T10 is equal to the constant voltage $V_{cm}$. However, since the cross-voltage $V_{ds}$ between the drain and the source of the third TFT T30 is not substantially 0, the voltage Vgs between the gate g and the source s of the first TFT T10 is not equal to the expected value, but the deviation is not taken seriously.

Please also refer to FIG. 1 and FIG. 2, the detection mode is divided into the potential resetting stage and the charging stage. The potential resetting stage still maintains the state shown in FIG. 1; after entering the charging stage, the second TFT T20 is turned off, the first TFT T10 flows through the current ID, and the current ID flows through the third TFT T30. At this stage, based on the detected voltage of the source s of the first TFT T10, the threshold voltage and the carrier mobility of the first TFT T10 can be calculated. The existing external electrical compensation detection method also ignores the cross-voltage between the drain and the source of the third TFT T30 in the detection mode. It is considered that the voltage $V_{sense}$ detected at the source of the third TFT T30 is equal to the voltage of the source s of the first TFT T10. Strictly speaking, this omission inevitably brings about error, resulting in errors in the calculated threshold voltage and carrier mobility of the first TFT T10. The purpose of the present disclosure is to provide an AMOLED external electrical compensation detection method which can improve the accuracy of AMOLED external electrical compensation detection, improve the writing accuracy of gate-source voltage of the driving TFT in the display mode and reduce the calculation error of the threshold voltage and the carrier mobility of the driving TFT in the detection mode.

SUMMARY OF THE DISCLOSURE

The purpose of the present disclosure is to provide an AMOLED external electrical compensation detection method which can improve the accuracy of AMOLED external electrical compensation detection, improve the writing accuracy of the gate-source voltage of the driving TFT in the display mode and reduce the calculation error of the threshold voltage and the carrier mobility of the driving TFT in the detection mode.

To achieve the above object, the present disclosure provides an AMOLED external electrical compensation detection method, including the following steps:

step S1, providing an AMOLED display;

the AMOLED display has an external compensation pixel circuit arranged in an array, the external compensation pixel circuit includes a driving TFT, a switching TFT, a detecting TFT, an OLED and a capacitor;

a gate of the switching TFT is connected to receive a scanning signal, a drain of the switching TFT is connected to receive a data signal, a source of the switching TFT is electrically connected to a gate of the driving TFT; a drain of the driving TFT is connected to receive a positive voltage of a power supply, a source of the driving TFT is electrically connected to a drain of the detecting TFT; a gate of the detecting TFT is connected to receive a control signal, a source of the detecting TFT is electrically connected to a detecting wire; an anode of the OLED is electrically connected to the source of the driving TFT, a cathode of the OLED is connected to receive a negative voltage of the power supply; a terminal of the capacitor is electrically connected to the gate of the driving TFT, and another terminal of the capacitor is electrically connected to the source of the driving TFT;

step S2, entering a display mode, estimating a cross-voltage between the drain and the source of the detecting TFT first, then calculating a gate-source voltage of the driving TFT based on an estimated value of the cross-voltage between the drain and the source of the detecting TFT;

step S3, entering a detection mode, estimating a cross-voltage between the drain and the source of the detecting TFT first, then calculating a source voltage of the driving TFT based on an estimated value of the cross-voltage between the drain and the source of the detecting TFT.

The AMOLED external electrical compensation detection method further including a step S4, calculating a threshold voltage and a carrier mobility of the driving TFT based on the voltage of the source of the driving TFT calculated in the step S3.

in the step S2, the scanning signal controls the switching TFT to turn on, the control signal controls the detecting TFT to turn on, the detecting wire connects to receive a constant voltage, a voltage of the data signal is written into the gate of the driving TFT, and the detecting TFT operates in its linear area.

In the step S2, an estimation formula of the cross-voltage between the drain and the source of the detecting TFT is:

$$V_{ds3} = \frac{2a + b - \sqrt{b^2 + 4ab}}{2}$$

$V_{ds3}$ is the cross-voltage between the drain and the source of the detecting TFT;

$$a = V_{Data} - V_{cm} - V_{th1};$$

$V_{Data}$ is a voltage of the data signal, $V_{cm}$ is the constant voltage, and $V_{th1}$ is a design value of the threshold voltage of the driving TFT;

$$b = \frac{2L_1 W_3}{W_1 L_3}(VGH - V_{cm} - V_{th3})$$

wherein, $L_1$ is a channel length of the driving TFT, $W_1$ is a channel width of the driving TFT, $L_3$ is a channel length of the detecting TFT, $W_3$ is a channel width of the detecting TFT, VGH is a voltage of the gate of the driving TFT at the moment of opening, and $V_{th3}$ is a design value of the threshold voltage of the detecting TFT.

in the step S2, a calculation formula of the gate-source voltage of the driving TFT is:

$$V_{gs} = V_{Data} - V_{cm} - V_{ds3};$$

wherein, $V_{gs}$ is the gate-source voltage of the driving TFT.

in the step S3, the detection mode is divided into a potential resetting stage and a charging stage; in the potential resetting stage, the scanning signal controls the switching TFT to turn on, the control signal controls the detecting TFT to turn on, the detecting wire connects to receive a constant voltage, and a voltage of the data signal is written into the gate of the driving TFT; in the charging stage, the scanning signal controls the switching TFT to turn off, the control signal still controls the detecting TFT to turn on, and the detecting wire is floating and the voltage of the source of the detecting TFT is detected.

in the charging stage of the step S3, an estimation formula of the cross-voltage between the drain and the source of the detecting TFT is:

$$V_{ds3} = \frac{2a + y - \sqrt{y^2 + 4ay}}{2}$$

$V_{ds3}$ is the cross-voltage between the drain and the source of the detecting TFT;

$$a = V_{Data} - V_{cm} - V_{th1};$$

$V_{Data}$ is a voltage of the data signal, $V_{cm}$ is the constant voltage, and $V_{th1}$ is a design value of the threshold voltage of the driving TFT;

$$y = \frac{2L_1 W_3}{W_1 L_3}(VGH - V_{sense} - V_{th3})$$

wherein, $L_1$ is a channel length of the driving TFT, $W_1$ is a channel width of the driving TFT, $L_3$ is a channel length of the detecting TFT, $W_3$ is a channel width of the detecting TFT, VGH is a voltage of the gate of the driving TFT at the moment of opening, $V_{sense}$ is a voltage of the source of the detecting TFT detected by the detecting wire, and $V_{th3}$ is a design value of the threshold voltage of the detecting TFT.

in the charging stage of the step S3, a calculation formula of a voltage of the source of the driving TFT is:

$$V_s = V_{sense} + V_{ds3};$$

wherein, $V_s$ is the voltage of the source of the driving TFT.

The present disclosure further provides an AMOLED external electrical compensation detection method, including the steps of:

step S1, providing an AMOLED display;

the AMOLED display has an external compensation pixel circuit arranged in an array, the external compensation pixel circuit includes a driving TFT, a switching TFT, a detecting TFT, an OLED and a capacitor;

a gate of the switching TFT is connected to receive a scanning signal, a drain of the switching TFT is connected to receive a data signal, a source of the switching TFT is electrically connected to a gate of the driving TFT; a drain of the driving TFT is connected to receive a positive voltage of a power supply, a source of the driving TFT is electrically connected to a drain of the detecting TFT; a gate of the detecting TFT is connected to receive a control signal, a source of the detecting TFT is electrically connected to a detecting wire; an anode of the OLED is electrically connected to the source of the driving TFT, a cathode of the OLED is connected to receive a negative voltage of the power supply; a terminal of the capacitor is electrically connected to the gate of the driving TFT, and another terminal of the capacitor is electrically connected to the source of the driving TFT;

step S2, entering a display mode, estimating a cross-voltage between the drain and the source of the detecting TFT first, then calculating a gate-source voltage of the driving TFT based on an estimated value of the cross-voltage between the drain and the source of the detecting TFT;

step S3, entering a detection mode, estimating a cross-voltage between the drain and the source of the detecting TFT first, then calculating a source voltage of the driving TFT based on an estimated value of the cross-voltage between the drain and the source of the detecting TFT;

step S4, calculating a threshold voltage and a carrier mobility of the driving TFT based on the voltage of the source of the driving TFT calculated in the step S3;

in the step S2, the scanning signal controls the switching TFT to turn on, the control signal controls the detecting TFT to turn on, the detecting wire connects to receive a constant voltage, a voltage of the data signal is written into the gate of the driving TFT, and the detecting TFT operates in its linear area;

in the step S2, an estimation formula of the cross-voltage between the drain and the source of the detecting TFT is:

$$V_{ds3} = \frac{2a + b - \sqrt{b^2 + 4ab}}{2}$$

$V_{ds3}$ is the cross-voltage between the drain and the source of the detecting TFT;

$a = V_{Data} - V_{cm} - V_{th1}$;

$V_{Data}$ is a voltage of the data signal, $V_{cm}$ is the constant voltage, and $V_{th1}$ is a design value of the threshold voltage of the driving TFT;

$$b = \frac{2L_1W_3}{W_1L_3}(VGH - V_{cm} - V_{th3})$$

wherein, $L_1$ is a channel length of the driving TFT, $W_1$ is a channel width of the driving TFT, $L_3$ is a channel length of the detecting TFT, $W_3$ is a channel width of the detecting TFT, VGH is a voltage of the gate of the driving TFT at the moment of opening, and $V_{th3}$ is a design value of the threshold voltage of the detecting TFT;

in the step S2, a calculation formula of the gate-source voltage of the driving TFT is:

$V_{gs} = V_{Data} - V_{cm} - V_{ds3}$;

wherein, $V_{gs}$ is the gate-source voltage of the driving TFT.

The beneficial effects of the present disclosure are as follows: the present disclosure providing an AMOLED external electrical compensation detection method, in the display mode, estimating a cross-voltage between the drain and the source of the detecting TFT first, then calculating a gate-source voltage of the driving TFT based on an estimated value of the cross-voltage between the drain and the source of the detecting TFT. Compared with the prior art solution of neglecting the cross-voltage between the drain and the source of the detecting TFT, it is possible to improve the writing precision of the gate-source voltage of the driving TFT. In the detection mode, estimating a cross-voltage between the drain and the source of the detecting TFT first, calculating a source voltage of the driving TFT based on an estimated value of the cross-voltage between the drain and the source of the detecting TFT, then, calculating the threshold voltage and the carrier mobility of the driving TFT based on the calculated voltage of the source of the driving TFT. Compared with the prior art solution of neglecting the cross-voltage between the drain and the source of the detecting TFT, it is possible to reduce the calculation error between the threshold voltage and the carrier mobility of the driving TFT and improve the accuracy of the external electrical compensation detection of the AMOLED.

BRIEF DESCRIPTION OF THE DRAWINGS

For further understanding of the features and technical contents of the present disclosure, reference should be made to the following detailed description and accompanying drawings of the present disclosure. However, the drawings are for reference only and are not intended to limit the present disclosure. In the figures.

DETAILED DESCRIPTION OF PREFERRED EMBODIMENTS

To further illustrate the technical means adopted by the present disclosure and the effects thereof, the following describes the preferred embodiments of the present disclosure and the accompanying drawings in detail.

Figure 1:
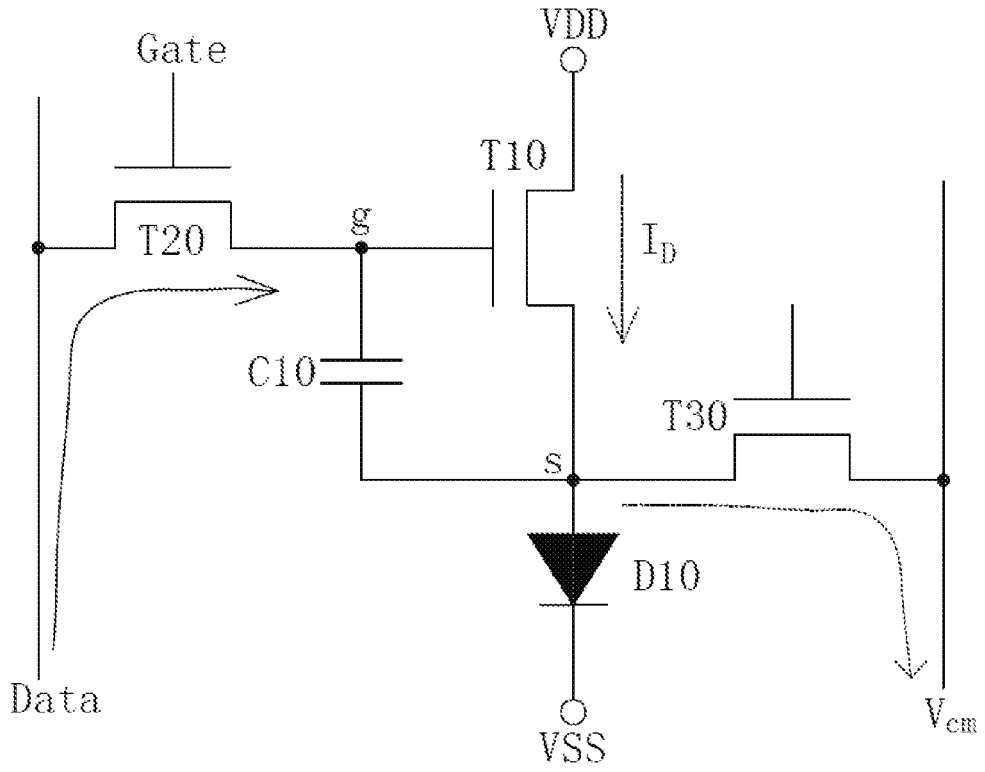
FIG. 1 is a schematic diagram of a state of an external compensation pixel circuit of the existing 3T1C structure in the potential resetting stage of the display mode and the detection mode.
Figure 2:
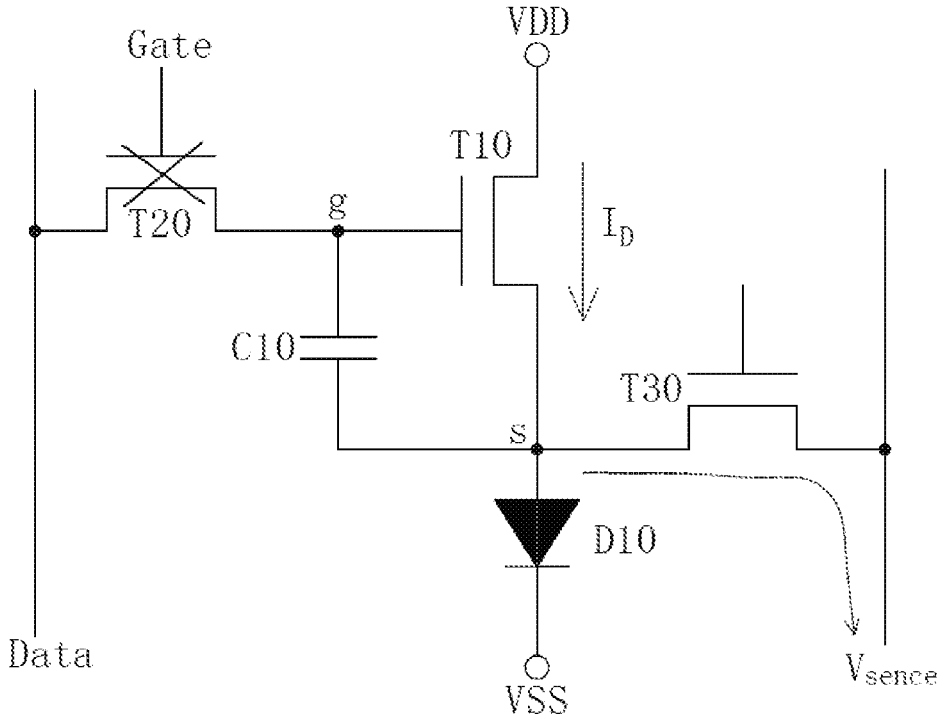
FIG. 2 is a schematic diagram of a state of the external compensation pixel circuit of the existing 3T1C structure in the charging stage of the detection mode.
Figure 3:
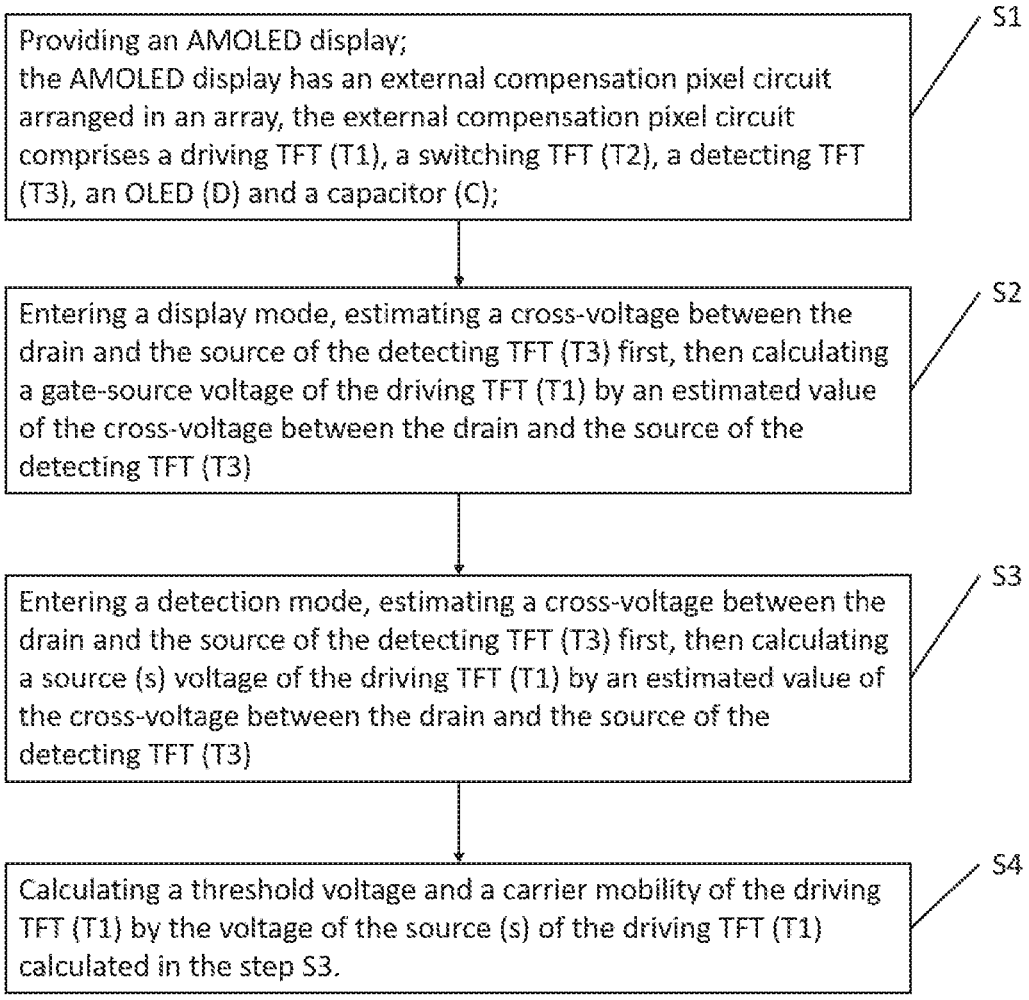
FIG. 3 is a flowchart of the AMOLED external electrical compensation detection method of the present disclosure.
Figure 4:
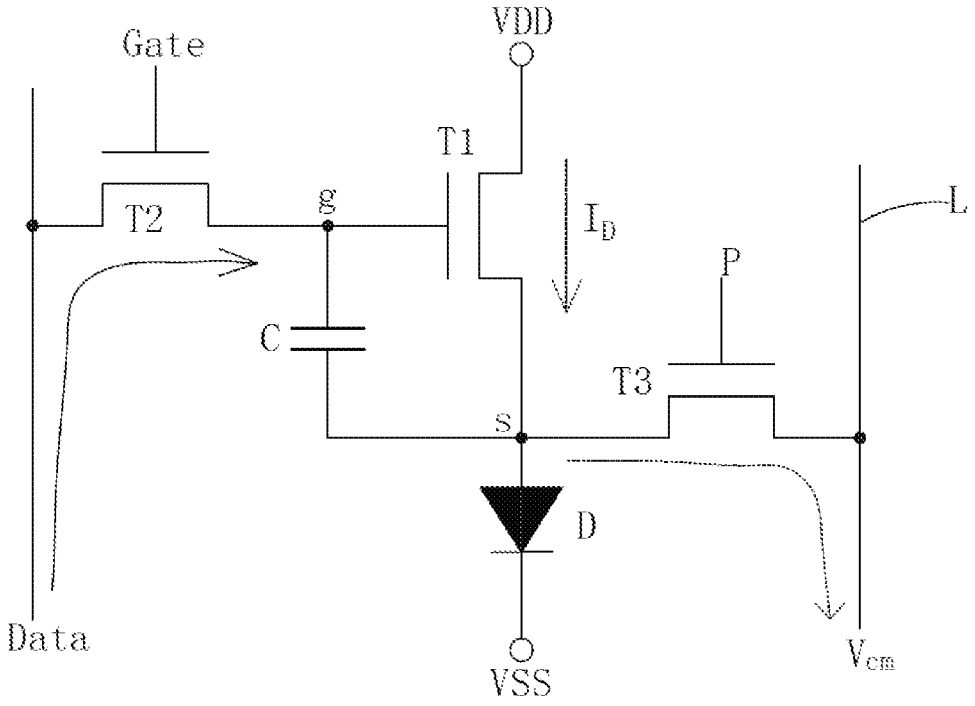
FIG. 4 is a schematic diagram of a state of the external compensation pixel circuit in the potential resetting stage of the display mode and the detection mode of the AMOLED external electrical compensation detection method of the present disclosure.
Figure 5:
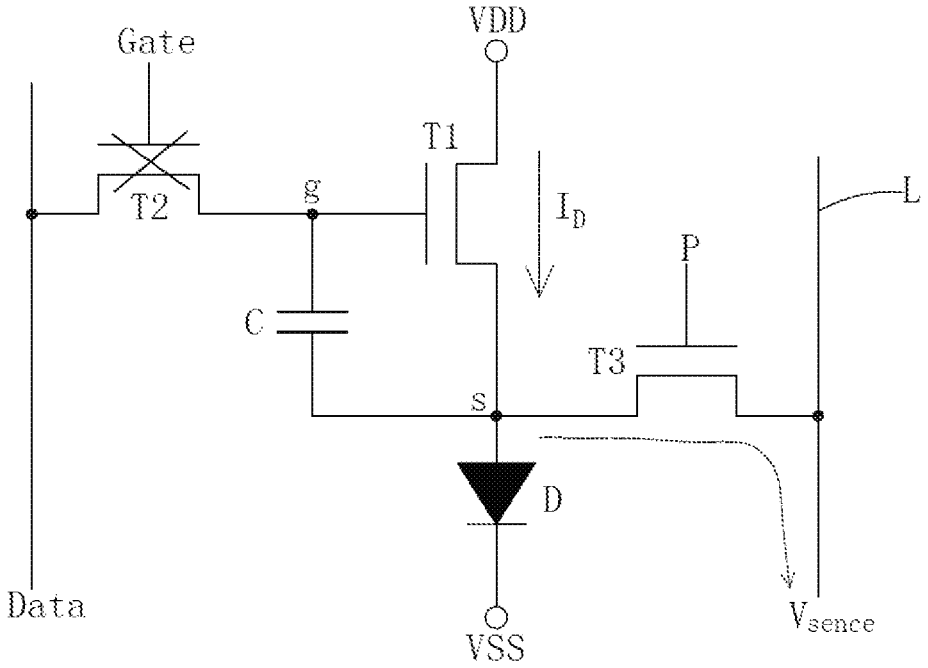
FIG. 5 is a schematic diagram of a state of the external compensation pixel circuit in the charging stage of the detection mode of the AMOLED external electrical compensation detection method of the present disclosure.

Please also refer to FIG. 3, FIG. 4 and FIG. 5, the present disclosure provides an AMOLED external electrical compensation detection method, including the following steps:

step S1, providing an AMOLED display.

As shown in FIG. 4 and FIG. 5, the AMOLED display has an external compensation pixel circuit arranged in an array, the external compensation pixel circuit includes a driving TFT T1, a switching TFT T2, a detecting TFT T3, an organic light emitting diode D and a capacitor C.

Specifically, a gate of the switching TFT T2 is connected to receive a scanning signal Gate, a drain of the switching TFT T2 is connected to receive a data signal Data, a source of the switching TFT T2 is electrically connected to a gate g of the driving TFT T1; a drain of the driving TFT T1 is connected to receive a positive voltage of a power supply VDD, a source s of the driving TFT T1 is electrically connected to a drain of the detecting TFT T3; a gate of the detecting TFT T3 is connected to receive a control signal P, a source of the detecting TFT T3 is electrically connected to a detecting wire L; an anode of the OLED D is electrically connected to the source s of the driving TFT T1, a cathode of the OLED D is connected to receive a negative voltage of the power supply VSS; a terminal of the capacitor C is electrically connected to the gate g of the driving TFT T1, and another terminal of the capacitor C is electrically connected to the source s of the driving TFT T1;

step S2, as shown in FIG. 4, entering a display mode, wherein the scanning signal Gate controls the switching TFT T2 to turn on, the voltage of the data signal Data is written into the gate g of the driving TFT T1; the detecting wire L is connected to receive a constant voltage $V_{cm}$ and sends the constant voltage $V_{cm}$ to the source of the detecting TFT T3.

The detecting TFT T3 is operated in its linear area (the working state of the TFT is divided into a linear area and a saturation area, when the cross-voltage between the drain and the source of the TFT is less than the difference between the gate-source voltage and the threshold voltage, the TFT in the linear area is equal to the resistance), the drain and the source of the detecting TFT T3 are equivalent to one resistance. The current $I_D$ flows through the driving TFT T1 and the detecting TFT T3. The current direction is as shown by the dotted arrows in FIG. 4.

In display mode, estimating a cross-voltage between the drain and the source of the detecting TFT T3:

$$V_{ds3} = \frac{2a + b - \sqrt{b^2 + 4ab}}{2}$$

wherein, $$a = V_{Data} - V_{cm} - V_{th1};$$

further, $V_{Data}$ is the voltage of the data signal Data, $V_{cm}$ is the constant voltage (about 1V), and $V_{th1}$ is the threshold voltage of the driving TFT T1, since the difference between the pixels of the threshold voltage $V_{th1}$ of the driving TFT T1 has little influence on the estimation, the design value of the threshold voltage $V_{th1}$ can be taken;

$$b = \frac{2L_1 W_3}{W_1 L_3}(VGH - V_{cm} - V_{th3})$$

further, $L_1$ is a channel length of the driving TFT T1, $W_1$ is a channel width of the driving TFT T1, $L_3$ is a channel length of the detecting TFT T3, $W_3$ is a channel width of the detecting TFT T1, VGH is a voltage (about 22V) of the gate g of the driving TFT T1 at the moment of opening, and $V_{th3}$ is the threshold voltage of the detecting TFT T3, since the difference between the pixels in the threshold voltage $V_{th3}$ of the detecting TFT T3 has little influence on the estimation, the design value of the threshold voltage $V_{th3}$ can be taken;

and then calculating the gate-source voltage $V_{gs}$ of the driving TFT T1 based on the estimated value of the voltage $V_{ds3}$ between the drain and the source of the detecting TFT T3:

$$V_{gs} = V_{Data} - V_{cm} - V_{ds3}.$$

Compared with the prior art solution of neglecting the cross-voltage between the drain and the source of the detecting TFT, the step S2 estimates the cross-voltage $V_{ds3}$ between the drain and the source of the detecting TFT T3 and uses the corresponding estimated value to calculate the gate-source voltage $V_{gs}$ of the driving TFT T1. It is possible to improve the writing accuracy of the gate-source voltage $V_{gs}$ of the driving TFT T1.

step S3, entering the detection mode. The detection mode is divided into the potential resetting stage as shown in FIG. 4 and the charging stage as shown in FIG. 5. In the potential resetting stage, the scanning signal Gate controls the switching TFT T2 to turn on, the control signal P controls the detecting TFT T3 to turn on, the detecting wire L connects to receive a constant voltage $V_{cm}$, the voltage of the data signal Data is written into the gate g of the driving TFT T1. In the charging stage, the scanning signal Gate controls the switching TFT T2 to turn off; the control signal P still controls the detecting TFT T3 to turn on, the detecting TFT T3 operates in its linear area, the drain and the source of the detecting TFT T3 are equivalent to one resistance, the current $I_D$ flows through the driving TFT T1 and the detecting TFT T3, and the current direction is as shown by the dotted arrow in FIG. 5; the detecting wire L is floating (that is, the constant voltage $V_{cm}$ is turned off) and the voltage $V_{sense}$ of the source of the detecting TFT T3 is detected.

Since the current $I_D$ is constant during the charging stage, and the detecting TFT T3 is in the linear region, the cross-voltage $V_{ds3}$ between the drain and the source of the detecting TFT T3 is constant, and the voltage $V_{ds3}$ still exists when detecting. In this case, the cross-voltage $V_{ds3}$ between the drain and the source of the detecting TFT T3 can be estimated by the following formula:

$$V_{ds3} = \frac{2a + y - \sqrt{y^2 + 4ay}}{2}$$

wherein:

$$a = V_{Data} - V_{cm} - V_{th1};$$

further, $V_{Data}$ is the voltage of the data signal Data, Van is the constant voltage (about 1V), $V_{th1}$ is the threshold voltage of the driving TFT T1, since the difference between the pixels of the threshold voltage $V_{th1}$ of the driving TFT T1 has little influence on the estimation, the design value of the threshold voltage $V_{th1}$ can be taken;

$$y = \frac{2L_1 W_3}{W_1 L_3}(VGH - V_{sense} - V_{th3})$$

further, $L_1$ is a channel length of the driving TFT T1, $W_1$ is a channel width of the driving TFT T1, $L_3$ is a channel length of the detecting TFT T3, $W_3$ is a channel width of the detecting TFT T1, VGH is a voltage (about 22V) of the gate g of the driving TFT T1 at the moment of opening, $V_{sense}$ is the voltage of the source of the detecting TFT T3 detected by the detecting wire L, and $V_{th3}$ is the threshold voltage of the detecting TFT T3, since the difference between the pixels in the threshold voltage $V_{th3}$ of the detecting TFT T3 has little influence on the estimation, the design value of the threshold voltage $V_{th3}$ can be taken;

after calculating the cross-voltage $V_{ds3}$ between the drain and the source of the detecting TFT T3, calculating the voltage $V_s$ of the source s of the driving TFT T1 based on the corresponding estimated value:

$$V_s = V_{sense} + V_{ds3}.$$

and step S4, calculating the threshold voltage and the carrier mobility of the driving TFT T1 based on the voltage $V_s$ of the source s of the driving TFT T1 calculated in the step S3.

In this step S4, an algorithm that is used in the industry to calculate the threshold voltage and the carrier mobility of the driving TFT T1 may be used, which is not described herein.

Since the above step S3 uses the estimated value of the cross-voltage $V_{ds3}$ between the drain and the source of the detecting TFT T3 for calculating the voltage $V_s$ of the source s of the driving TFT T1, the voltage $V_s$ of the source electrode s of the driving TFT T1 used for calculating the threshold voltage and the carrier mobility for driving the TFT T1 in step S4 considers the cross-voltage $V_{ds3}$ between the drain and the source of the detecting TFT T3. Compared with the prior art solution for detecting the cross-voltage $V_{ds3}$ between the drain and the source of the detecting TFT T3, the calculation error between the threshold voltage of the driving TFT T1 and the carrier mobility can be reduced.

In summary, the present disclosure providing an AMOLED external electrical compensation detection method, in the display mode, estimating a cross-voltage between the drain and the source of the detecting TFT first, then calculating a gate-source voltage of the driving TFT based on an estimated value of the cross-voltage between the drain and the source of the detecting TFT. Compared with the prior art solution of neglecting the cross-voltage between the drain and the source of the detecting TFT, it is possible to improve the writing precision of the gate-source voltage of the driving TFT. In the detection mode, estimating a cross-voltage between the drain and the source of the detecting TFT first, calculating a source voltage of the driving TFT based on an estimated value of the cross-voltage between the drain and the source of the detecting TFT, then, calculating the threshold voltage and the carrier mobility of the driving TFT based on the calculated voltage of the source of the driving TFT. Compared with the prior art solution of neglecting the cross-voltage between the drain and the source of the detecting TFT, it is possible to reduce the calculation error between the threshold voltage and the carrier mobility of the driving TFT and improve the accuracy of the external electrical compensation detection of the AMOLED.

It should be understood by those skilled in the art that various modifications and variations can be made in the light of the technical solutions and technical concepts of the present disclosure. All such changes and modifications shall fall within the protection scope of the claims of the present disclosure.

What is claimed is:

1. An AMOLED external electrical compensation detection method, comprising the steps of:

step S1: providing an AMOLED display;

the AMOLED display has an external compensation pixel circuit arranged in an array, the external compensation pixel circuit comprises a driving TFT, a switching TFT, a detecting TFT, an OLED and a capacitor;

a gate of the switching TFT is connected to receive a scanning signal, a drain of the switching TFT is connected to receive a data signal, a source of the switching TFT is electrically connected to a gate of the driving TFT; a drain of the driving TFT is connected to receive a positive voltage of a power supply, a source of the driving TFT is electrically connected to a drain of the detecting TFT; a gate of the detecting TFT is connected to receive a control signal, a source of the detecting TFT is electrically connected to a detecting wire; an anode of the OLED is electrically connected to the source of the driving TFT, a cathode of the OLED is connected to receive a negative voltage of the power supply; a terminal of the capacitor is electrically connected to the gate of the driving TFT, and another terminal of the capacitor is electrically connected to the source of the driving TFT;

step S2: entering a display mode, estimating an estimated value of a cross-voltage between the drain and the source of the detecting TFT in the display mode, and calculating a gate-source voltage of the driving TFT based on the estimated value of the cross-voltage between the drain and the source of the detecting TFT in the display mode; and step S3: entering a detection mode, estimating an estimated value of a cross-voltage between the drain and the source of the detecting TFT in the detection mode, and calculating a source voltage of the driving TFT based on the estimated value of the cross-voltage between the drain and the source of the detecting TFT in the detection mode, wherein in the step S2, an estimation formula of the cross-voltage between the drain and the source of the detecting TFT in the display mode is:

$$V_{ds3} = \frac{2a + b - \sqrt{b^2 + 4ab}}{2};$$

$V_{ds3}$ is the cross-voltage between the drain and the source of the detecting TFT;

$a = V_{Data} - V_{cm} V_{th1}$;

$V_{Data}$ is a voltage of the data signal, $V_{cm}$ is the constant voltage, and $V_{th1}$ is a design value of the threshold voltage of the driving TFT;

$$b = \frac{2L_1 W_3}{W_1 L_3}(VGH - V_{cm} - V_{th3});$$

wherein, $L_1$ is a channel length of the driving TFT, $W_1$ is a channel width of the driving TFT, $L_3$ is a channel length of the detecting TFT, $W_3$ is a channel width of the detecting TFT, VGH is a voltage of the gate of the driving TFT at the moment of opening, and $V_{th3}$ is a design value of the threshold voltage of the detecting TFT.

2. The AMOLED external electrical compensation detection method according to claim 1, further comprising a step S4, calculating a threshold voltage and a carrier mobility of the driving TFT based on the voltage of the source of the driving TFT calculated in the step S3.

3. The AMOLED external electrical compensation detection method according to claim 1, in the step S2, the scanning signal controls the switching TFT to turn on, the control signal controls the detecting TFT to turn on, the detecting wire connects to receive a constant voltage, a voltage of the data signal is written into the gate of the driving TFT, and the detecting TFT operates in its linear area.

4. The AMOLED external electrical compensation detection method according to claim 1, in the step S2, a calculation formula of the gate-source voltage of the driving TFT is:

$$V_{gs} = V_{Data} - V_{cm} - V_{ds3};$$

wherein, $V_{gs}$ is the gate-source voltage of the driving TFT.

5. The AMOLED external electrical compensation detection method according to claim 1, in the step S3, the detection mode is divided into a potential resetting stage and a charging stage; in the potential resetting stage, the scanning signal controls the switching TFT to turn on, the control signal controls the detecting TFT to turn on, the detecting wire connects to receive a constant voltage, and a voltage of the data signal is written into the gate of the driving TFT; in the charging stage, the scanning signal controls the switching TFT to turn off, the control signal still controls the detecting TFT to turn on, and the detecting wire is floating and the voltage of the source of the detecting TFT is detected.

6. The AMOLED external electrical compensation detection method according to claim 5, in the charging stage of the step S3, an estimation formula of the cross-voltage between the drain and the source of the detecting TFT in the detection mode is:

$$V_{ds3} = \frac{2a + y - \sqrt{y^2 + 4ay}}{2};$$

$V_{ds3}$ is the cross-voltage between the drain and the source of the detecting TFT;

$$a=V_{Data}-V_{cm}-V_{th1};$$

$V_{Data}$ is a voltage of the data signal, $V_{cm}$ is the constant voltage, and $V_{th1}$ is a design value of the threshold voltage of the driving TFT;

$$y=\frac{2L_1W_3}{W_1L_3}(VGH-V_{sense}-V_{th3});$$

wherein, $L_1$ is a channel length of the driving TFT, $W_1$ is a channel width of the driving TFT, $L_3$ is a channel length of the detecting TFT, $W_3$ is a channel width of the detecting TFT, VGH is a voltage of the gate of the driving TFT at the moment of opening, $V_{sense}$ is a voltage of the source of the detecting TFT detected by the detecting wire, and $V_{th3}$ is a design value of the threshold voltage of the detecting TFT.

7. The AMOLED external electrical compensation detection method according to claim 6, in the charging stage of the step S3, a calculation formula of the voltage of the source of the driving TFT is:

$$V_s=V_{sense}+V_{ds3};$$

wherein, $V_s$ is the voltage of the source of the driving TFT.

8. An AMOLED external electrical compensation detection method, comprising the steps of:

step S1, providing an AMOLED display;

the AMOLED display has an external compensation pixel circuit arranged in an array, the external compensation pixel circuit comprises a driving TFT, a switching TFT, a detecting TFT, an OLED and a capacitor;

a gate of the switching TFT is connected to receive a scanning signal, a drain of the switching TFT is connected to receive a data signal, a source of the switching TFT is electrically connected to a gate of the driving TFT; a drain of the driving TFT is connected to receive a positive voltage of a power supply, a source of the driving TFT is electrically connected to a drain of the detecting TFT; a gate of the detecting TFT is connected to receive a control signal, a source of the detecting TFT is electrically connected to a detecting wire; an anode of the OLED is electrically connected to the source of the driving TFT, a cathode of the OLED is connected to receive a negative voltage of the power supply; a terminal of the capacitor is electrically connected to the gate of the driving TFT, and another terminal of the capacitor is electrically connected to the source of the driving TFT;

step S2: entering a display mode, estimating an estimated value of a cross-voltage between the drain and the source of the detecting TFT in the display mode, and calculating a gate-source voltage of the driving TFT based on the estimated value of the cross-voltage between the drain and the source of the detecting TFT in the display mode;

step S3: entering a detection mode, estimating an estimated value of a cross-voltage between the drain and the source of the detecting TFT in the detection mode, and calculating a source voltage of the driving TFT based on the estimated value of the cross-voltage between the drain and the source of the detecting TFT in the detection mode;

step S4, calculating a threshold voltage and a carrier mobility of the driving TFT based on the voltage of the source of the driving TFT calculated in the step S3;

in the step S2, the scanning signal controls the switching TFT to turn on, the control signal controls the detecting TFT to turn on, the detecting wire connects to receive a constant voltage, a voltage of the data signal is written into the gate of the driving TFT, and the detecting TFT operates in its linear area;

in the step S2, an estimation formula of the cross-voltage between the drain and the source of the detecting TFT is:

$$V_{ds3}=\frac{2a+b-\sqrt{b^2+4ab}}{2};$$

$V_{ds3}$ is the cross-voltage between the drain and the source of the detecting TFT;

$$a=V_{Data}-V_{cm}V_{th1};$$

$V_{Data}$ is a voltage of the data signal, $V_{cm}$ is the constant voltage, and $V_{th1}$ is a design value of the threshold voltage of the driving TFT;

$$b=\frac{2L_1W_3}{W_1L_3}(VGH-V_{cm}-V_{th3});$$

wherein, $L_1$ is a channel length of the driving TFT, $W_1$ is a channel width of the driving TFT, $L_3$ is a channel length of the detecting TFT, $W_3$ is a channel width of the detecting TFT, VGH is a voltage of the gate of the driving TFT at the moment of opening, and $V_{th3}$ is a design value of the threshold voltage of the detecting TFT;

in the step S2, a calculation formula of the gate-source voltage of the driving TFT is:

$$V_{gs}=V_{Data}-V_{cm}-V_{ds3};$$

wherein, $V_{gs}$ is the gate-source voltage of the driving TFT.

9. The AMOLED external electrical compensation detection method according to claim 8, in the step S3, the detection mode is divided into a potential resetting stage and a charging stage; in the potential resetting stage, the scanning signal controls the switching TFT to turn on, the control signal controls the detecting TFT to turn on, the detecting wire connects to receive a constant voltage, and a voltage of the data signal is written into the gate of the driving TFT; in the charging stage, the scanning signal controls the switching TFT to turn off, the control signal still controls the detecting TFT to turn on, and the detecting wire is floating and the voltage of the source of the detecting TFT is detected.

10. The AMOLED external electrical compensation detection method according to claim 9, in the charging stage of the step S3, an estimation formula of the cross-voltage between the drain and the source of the detecting TFT in the detection mode is:

$$V_{ds3}=\frac{2a+yb-\sqrt{y^2+4ay}}{2};$$

$V_{ds3}$ is the cross-voltage between the drain and the source of the detecting TFT;

$$a=V_{Data}-V_{cm}-V_{th1};$$

$V_{Data}$ is a voltage of the data signal, $V_{cm}$ is the constant voltage, and $V_{th1}$ is a design value of the threshold voltage of the driving TFT;

$$y=\frac{2L_1W_3}{W_1L_3}(VGH-V_{sense}-V_{th3});$$

wherein, $L_1$ is a channel length of the driving TFT, $W_1$ is a channel width of the driving TFT, $L_3$ is a channel length of the detecting TFT, $W_3$ is a channel width of the detecting TFT, VGH is a voltage of the gate of the driving TFT at the moment of opening, $V_{sense}$ is a voltage of the source of the detecting TFT detected by the detecting wire, and $V_{th3}$ is a design value of the threshold voltage of the detecting TFT.

11. The AMOLED external electrical compensation detection method according to claim 10, in the charging stage of the step S3, a calculation formula of the voltage of the source of the driving TFT is:

$$V_s=V_{sense}+V_{ds3};$$

wherein, $V_s$ is the voltage of the source of the driving TFT.

* * * * *